US006401711B1

(12) United States Patent
Tibbs et al.

(10) Patent No.: US 6,401,711 B1
(45) Date of Patent: Jun. 11, 2002

(54) SUPERSNORKEL

(76) Inventors: Kenneth J. Tibbs; Dawn A. Tibbs, both of 491 W. Hackney Ave., Globe, AZ (US) 85501

( * ) Notice: Subject to any disclaimer, the term of this patent is extended or adjusted under 35 U.S.C. 154(b) by 0 days.

(21) Appl. No.: 09/270,253

(22) Filed: Mar. 15, 1999

Related U.S. Application Data

(60) Provisional application No. 60/078,345, filed on Mar. 17, 1998.

(51) Int. Cl.[7] ..... A61M 15/00

(52) U.S. Cl. ..... 128/201.11; 128/201.27

(58) Field of Search ..... 606/200.24, 201.11, 606/201.12, 201.19, 201.27, 201.22, 206.21, 206.28

(56) References Cited

U.S. PATENT DOCUMENTS 594,945 A * 12/1897 Gordon ..... 128/201.27
827,029 A * 7/1906 McGregor ..... 128/201.27
835,950 A * 11/1906 Iwanami ..... 128/201.27
1,305,656 A * 6/1919 Long ..... 128/201.27
5,265,591 A * 11/1993 Ferguson ..... 128/201.27
5,471,976 A * 12/1995 Smith ..... 128/204.26

* cited by examiner

*Primary Examiner*—Glenn K. Dawson
(74) *Attorney, Agent, or Firm*—Schmeiser, Olsen and Watts

(57) ABSTRACT

A diving device that allows the diver to go below the surface of the water and still breath surface pressure air. By using a plurality of check valves and a helmet and carapace, that keeps the surface pressure around the divers critical chest, head, neck, and abdominal area. The old law that you can not breathe surface pressure air below the surface is broken. 2 long hoses communicates with the surface, and allows even novice divers to reach 10 to 30 feet below the surface with a heretofore-unknown safety and ease. This can be thought of as taking a submarine to its smallest possible size.

25 Claims, 13 Drawing Sheets

SUPERSNORKEL

CROSS REFERENCES TO RELATED APPLICATIONS please refer back to provisional pat no 60/078,345 filing date of Mar. 17, 1998.

BACKGROUND

1. Field of Invention

This invention is related to diving gear specifically snorkeling and improving its performance. By allowing the diver to go to depths such as 20 ft with the safety of breathing surface air, and staying for extended lengths of time with out surfacing for air.

2. Description of Prior Art

Heretofore many types of snorkels have been invented and used but none allow the diver to leave the surface and still breath surface pressure air. One attempted this but with the following draw backs One such system shown in U.S. Pat. No. 4,022,201 to Diggs (1975) shows a diving cap for rebreathing air already used and a hose snorkel device. This would cause a build up of Co2 and a loss of O2(oxygen) severely limiting the time it could be used and I see no way of allowing the diver to breath through the tube snorkel as the water pressure would be too much for the accessory breathing muscles at any depth other then on the surface. Finally the wind up tube device would require some one on the surface to wind the handle.

Saito Masayasu shown in U.S. Pat. No. 4,061,140 shows a diving device with multiple check valves. This device requires that a diver stay on the surface and does not allow even free diving to any depth. Also, this device is heavy and ungainly and looks to be difficult to move through the water. Finally this device would be difficult to transport and would give no advantage over a normal snorkel that weighs a few ounces.

Green Thomas shown as U.S. Pat. No. 3,860,042 shows a device to allow a snorkel to be used without water entering and causing problems. This device forces the diver to hold his breath and pressure compensate his ears as he descends into the water. This is very difficult and indeed impossible for some people to do. Finally this requires the diver to wear a mask that precludes talking and limits the field of view;

Smith Raymond shown as U.S. Pat. No. 5,471,976 shows a device for staying below the surface of the water for a period of time. The problems with this patent have been solved by not having an electric powered compressor which gives you the problems and safety concerns of compressed air.

Houston Charles shown as U.S. Pat. No. 4,255,632 shows a device where-by the diver uses muscle power to compress air. I have solved the problems of this device by not requiring a muscle powered device which would certainly tire the diver. And also the dangers of compressed air have been solved.

Rustem Ganow et al shown as U.S. Pat. No. 5,193,530 shows a device where a compatriot pumps the air to the diver. I have solved the problems of this system by not having to have someone on the surface to pump. And also the problems with compressed air have been eliminated along with the possibility of pump failure.

Tragtschnig Joerg shown as U.S. Pat. No. 5,092,327 shows a diving device that incorporates a pump worn by the diver. I have solved the problems associated with such a system which would be very fatiguing to the diver. No pumps no compressed air or dangers associated with both.

OBJECTS AND ADVANTAGES

Accordingly, several objects and advantages of my invention are ease of use and especially the depth that even inexperienced snorkels can attain and stay at for extended lengths of time. The bubble helmet gives an unobstructed view, and there is no sound of excepting bubbles, no sound from a gasoline or electric motor or fumes from gas, batteries and such. With no compressed air, there is none of the inherent problems associated with this. No ear problems from pressure such as pain or perforation.

Both diving and assent are thus made simple and fun. The very simplicity of this system gives it a great degree of inherent reliability and safety (no carbon monoxide poisoning, no ear damage et.). The normal snorkel requires a rather difficult holding of breath pressurizing ears etc. to dive to any depths at all. With super snorkel, the transitions are smooth and effortless. Breathing surface air at depths of at least 20 ft and possibly a lot more. With a liquid food and water supply on board, an extended stay would be easy and even a lot of fun. Cleaning the bottom of boats would become easy and inexpensive. With no outside power necessary to compress air either electric or gas and fuel used to make both. This makes for an ecologically friendly unit. Even many disabled would be able to enjoy the fun of sea exploration. Even the military would find this invention useful due to its inexpensive nature and long underwater stay. The ability to speak is preserved by the simple design and makes the sharing of your experiences easier and more fun, thus affording thousands of people a convenient and safe way to explore. Even the ones with out previous diving experience can learn very quickly to use super snorkel.

Still further objects and advantages will become apparent from a consideration of the ensuing description and accompanying drawings.

DESCRIPTION OF DRAWINGS

FIG. 6-B Is the 2 valve arrangement to facilitate ease of breathing

FIG. 12-*b*. is a view of pants or shorts with thickened reinforced waist made of rubber. The reinforced waist fits in the groove in FIG. 12 s-1.

FIG. 12-*c*, 12-*d* and 12-*e* are side view of carapace with ballast 1 showing possible placement of weight to neutralize buoyancy of air in carapace b-1 is either buckles with ratchets to seal or hook and ring closures in overshirt version. Wp-1 to wp-3 is airtight seal for sleeve version.

FIG. 12-*f*. is a view of one-piece carapace that is put on from the bottom. This version is simpler but more difficult to put on.

FIG. 12-*g*. is front view of super snorkel with overshirt version in place. N-1 is the neck seal accomplished with ratchet version of belt &buckle. W-1 is waist version of the same.

FIG. 12-*h*. is a front view of supersnorkel with sleeves and pants (or short versions of either). SH-1 & SH-2 are sleeve seals W-2 is pants weal with racketing buckle as on ski boot bindings.

PREFERRED EMBODIMENT DESCRIPTION

Figure 1:
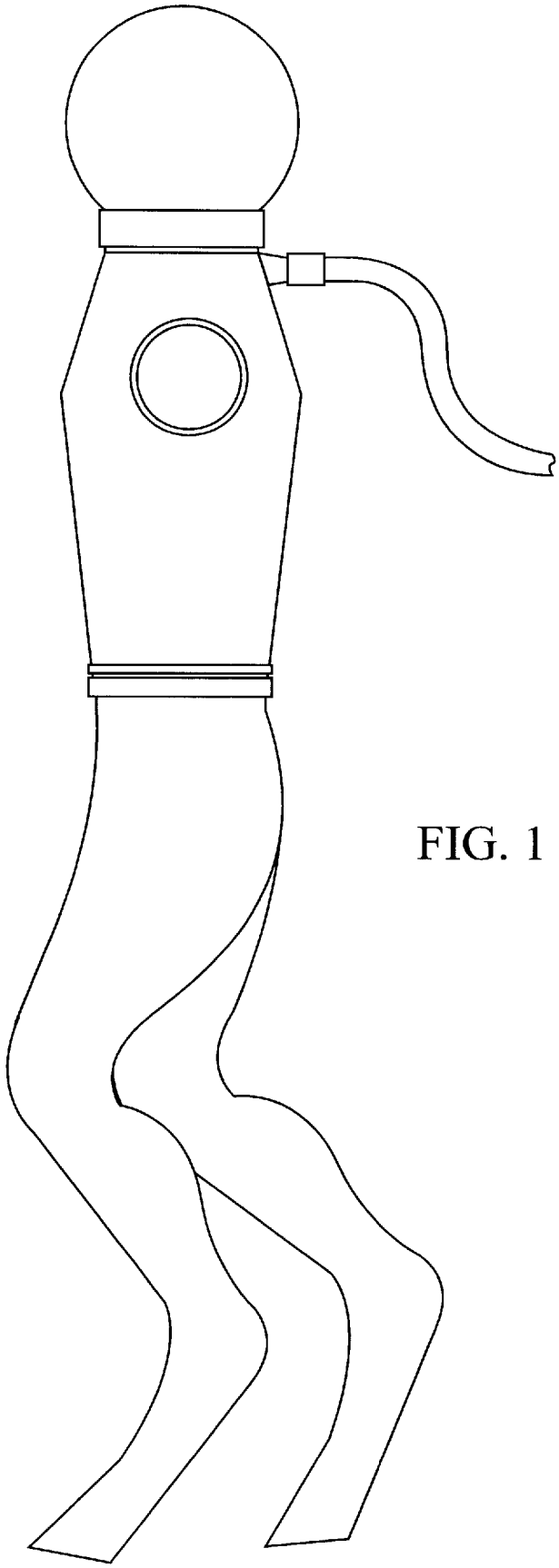
FIG. 1. Is a generalized drawing of super is snorkel. Showing most large parts in the position of use.

FIG. 1. Is a generalized drawing of super is snorkel. Showing most large parts in the position of use.

Figure 2:
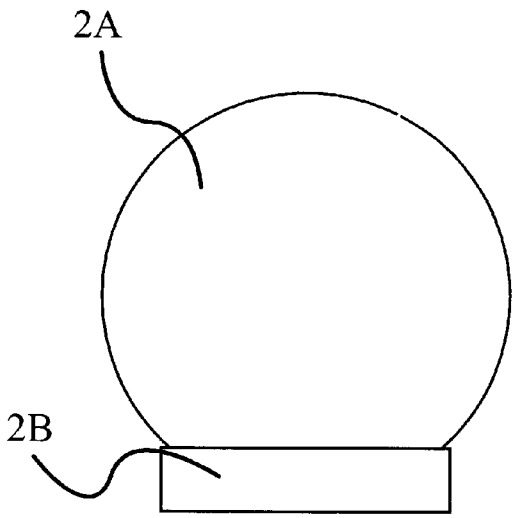
FIG. 2. Is a side view of the simple bubble helmet part 2*a* and is made from clear high impact plastic, and is made separate and attached to the base part 2*b*. Which contains the flange and rubber gasket seal like a pressure cooker for the attachment of the helmet. And also contains the attachment for the air hoses. It is either firmly and/or water tightly attached to the carapace or made integral with the carapace.

FIG. 2. Is a side view of the simple bubble helmet part 2*a* and is made from clear high impact plastic, and is made separate and attached to the base part 2*b*, which contains the flange and rubber gasket seal like a pressure cooker for the attachment of the helmet. It also contains the attachment for the air hoses, and is either firmly and water tightly attached to the carapace or made integral with the carapace.

Figure 3:
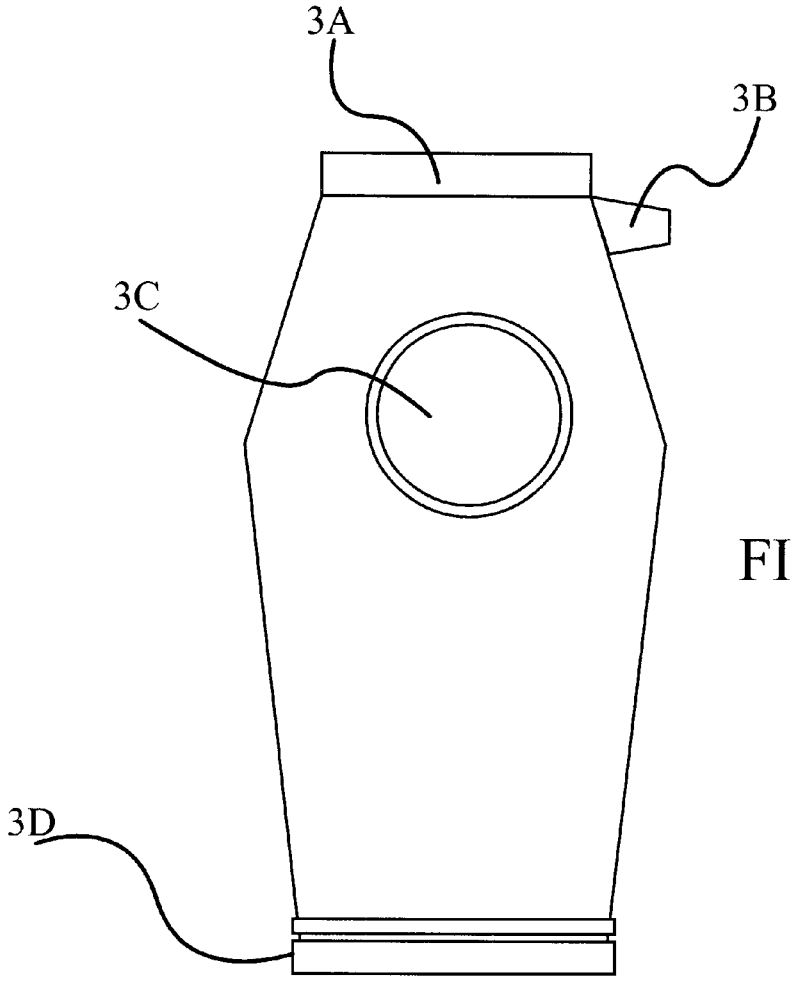
FIG. 3. Is a side view of the carapace (a one or 2 piece shell that protects the chest and diaphragm from pressure at depths to allow easy breathing). It is made of strong resistant plastic, metal or any space age pressure resistant material. A weight is on the chest portion. 3*a* is a neck flange with seal ring for helmet and 3*b* is a mount for intake and exhaust air hose attachments. 3*c* is the arm opening with an area for sealing for sleeves (not necessary on shirt type.). 3*d* is the seal ring for the pants & shirt on the shirt type.

FIG. 3. Is a side view of the carapace (a one or 2 piece shell that protects the chest and diaphragm from pressure at depths to allow easy breathing), it is made of strong resistant plastic, metal or any space age pressure resistant material. 3*a* is a neck flange with seal ring for helmet and 3*b* is a mount for intake and exhaust air hose attachments. 3*c* is the arm opening with an area for sealing for sleeves (not necessary on shirt type.). 3*d* is the seal ring for the pants & shirt on the shirt type.

Figure 4:
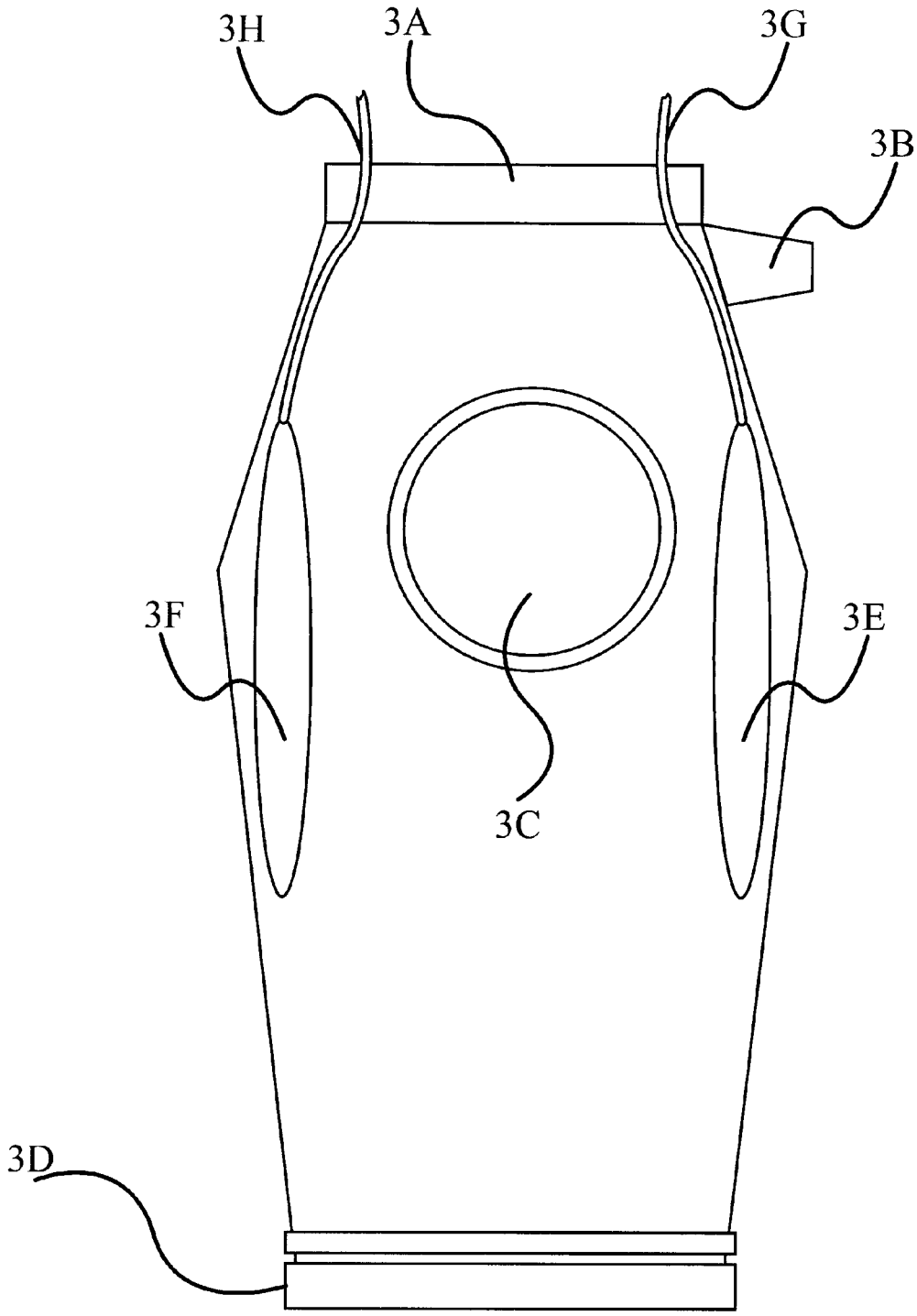
FIG. 4. Is a military carapace with additions of 3*e* liquid food bladder, 3*f* water bladder, 3*g* is the tube for taking food, 3*h* is the tube for taking water. Kevelar could be added to the carapace for protection form projectiles.

FIG. 4. Is a military carapace with additions of 3*e* liquid food bladder, 3*f* water bladder, 3*g* is the tube for taking food and 3*h* is the tube for taking water. Kevelar could be added to the carapace for protection form projectiles.

Figure 5:
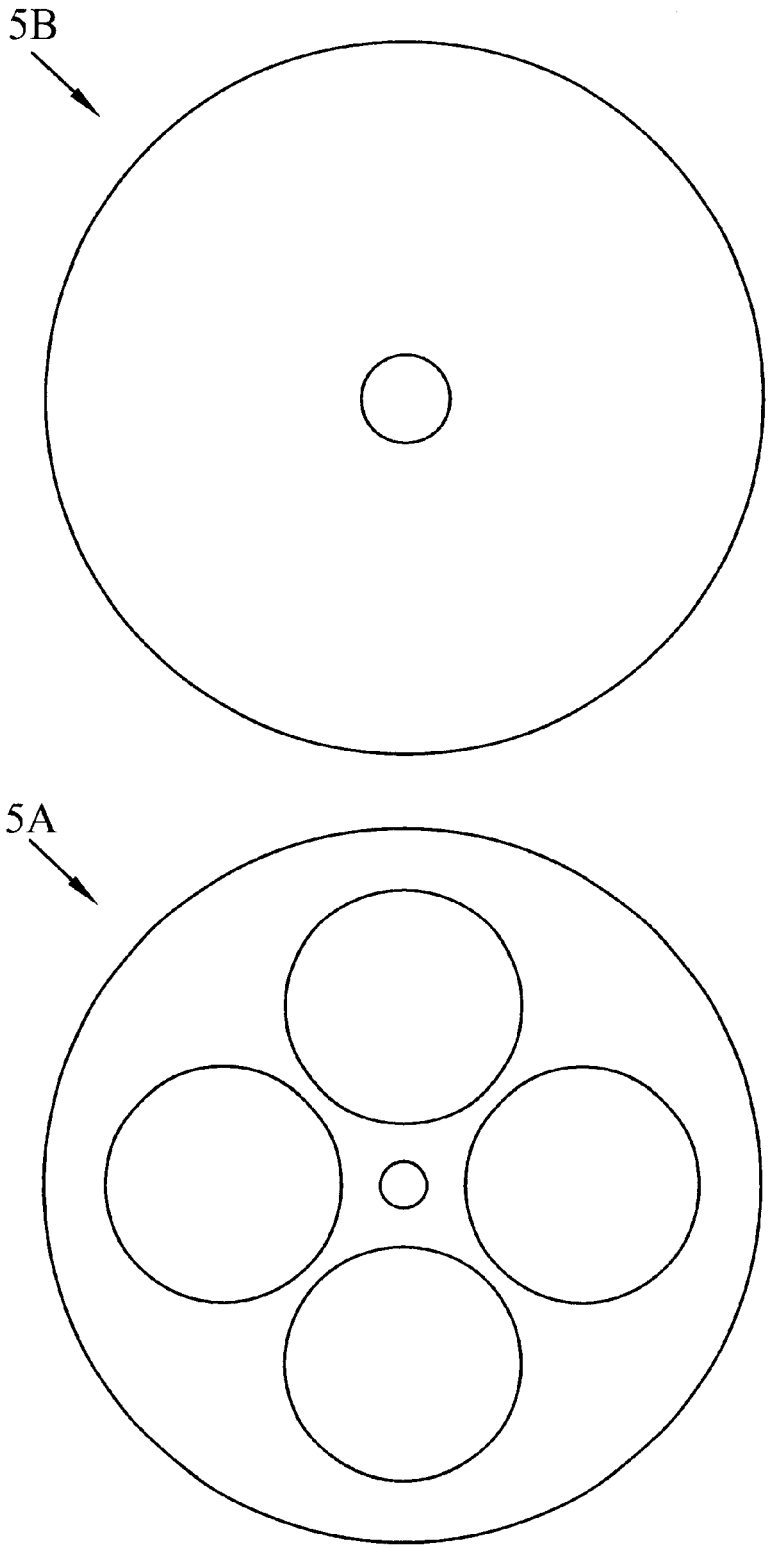
FIG. 5. Is a detail of the one way valves to control airflow in super snorkel. 5*a* is the base made of hard plastic. 5*b* is the flapper valve made of surgical rubber or an equivalent.

FIG. 5. Is a detail of the one way valves to control airflow in super snorkel. 5*a* is the base made of hard plastic. 5*b* is the flapper valve made of surgical rubber or an equivalent.

Figure 6:
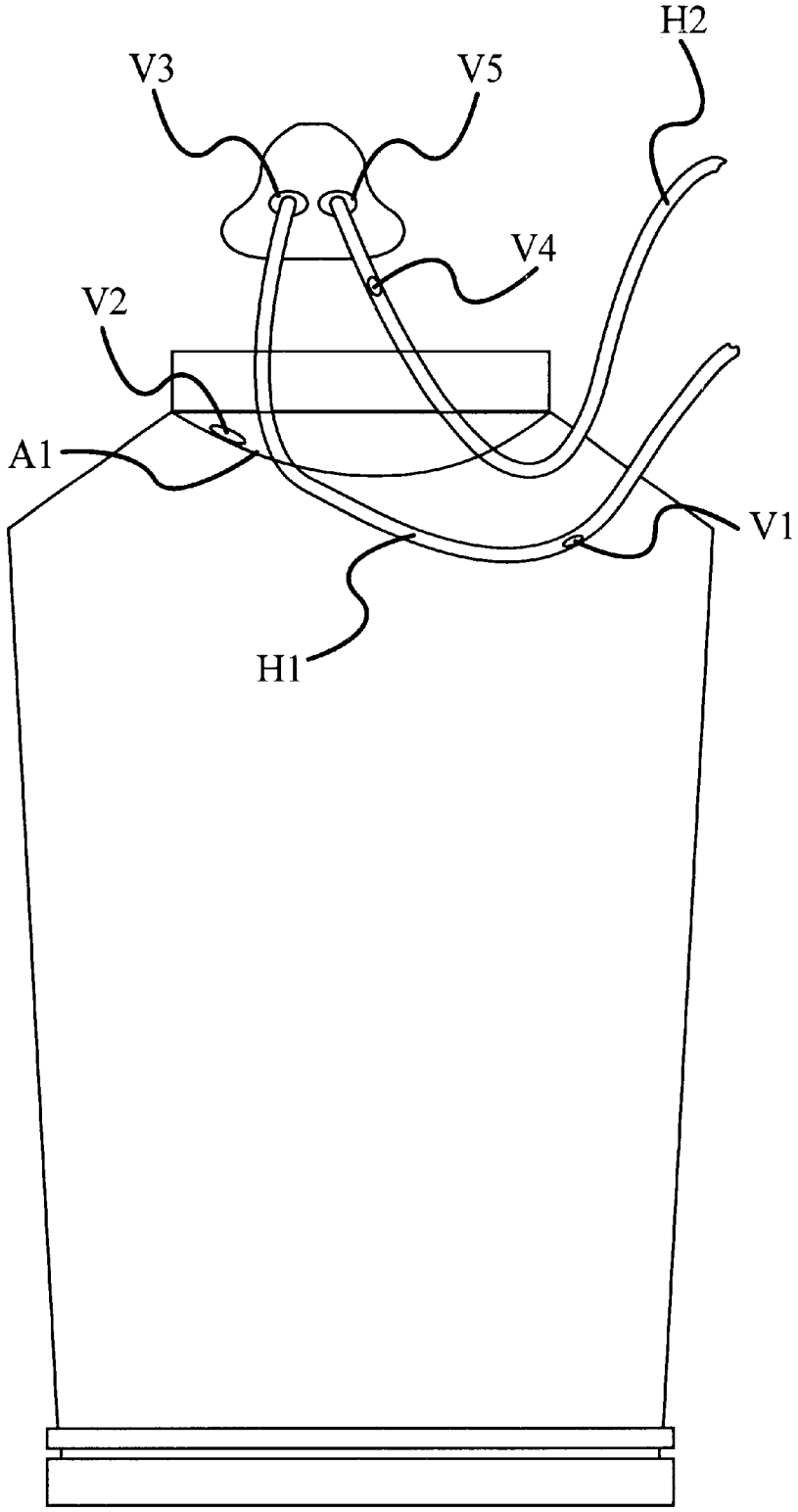
FIG. 6. Is a detail on the one way valve arrangement. V1 is an intake valve, V2 is an intake valve, v3 is an intake valve, v4 is an exhaust valve, v5 is an exhaust valve. A1 is the rubber neck apron containing v2 and v4. H1 is an air intake hose containing v1 & v3. H2 is an exhaust air hose containing v3 & v4. M1 is soft rubber mask covering the mouth and nose.
Figure 6B:
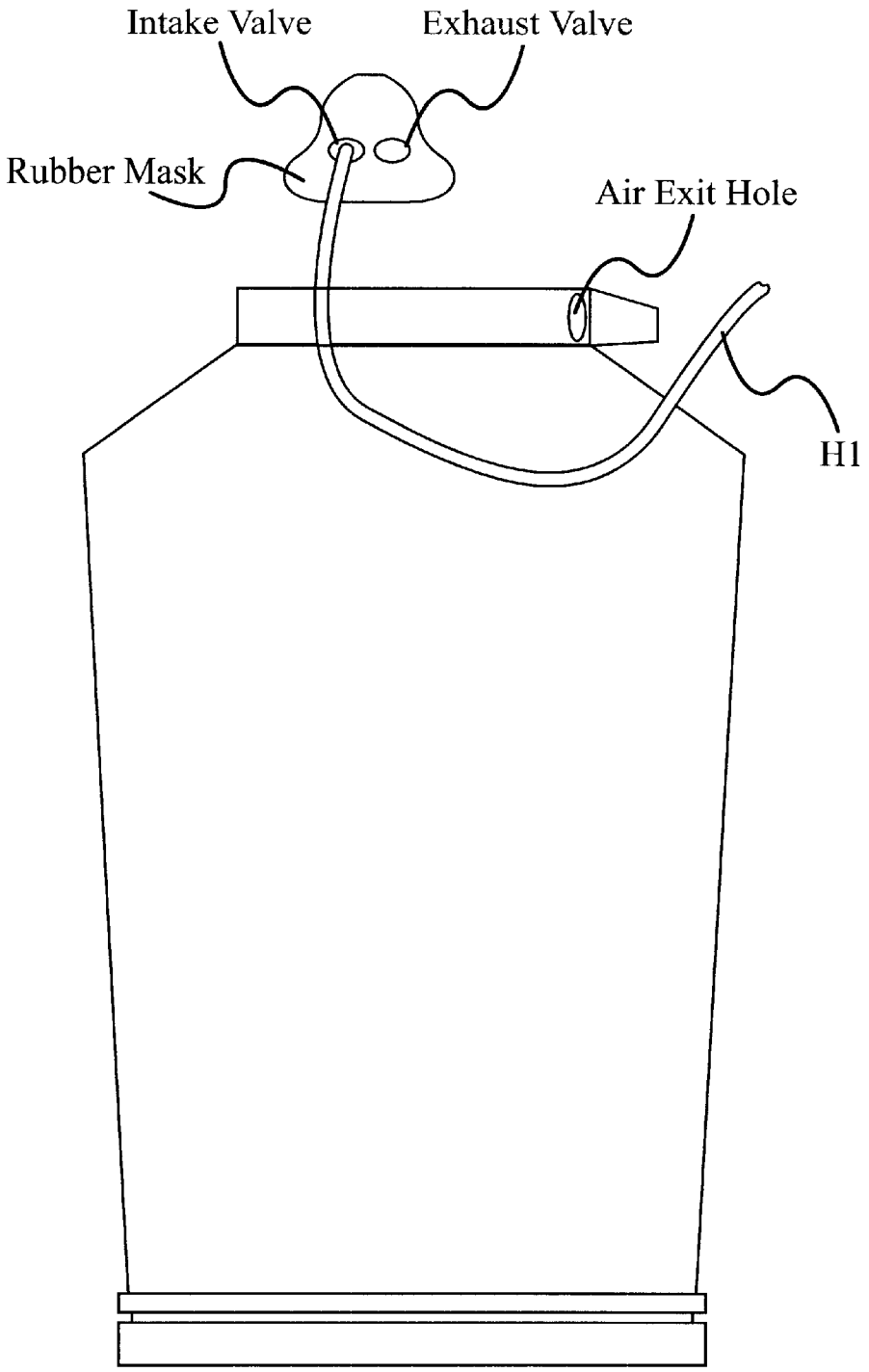

FIG. 6. Is a detail on the one way valve arrangement. V1 is an intake valve, V2 is an intake valve, v3 is an intake valve, v4 is an exhaust valve, and v5 is an exhaust valve. A1 is the rubber neck apron containing v2 and v4. H1 is an air intake hose containing v1 & v3. H2 is an exhaust air hose containing v3 & v4. M1 is soft rubber mask covering the mouth and nose.

FIG. 6-B Is a detail of the 2 valve arrangement

Figure 7:
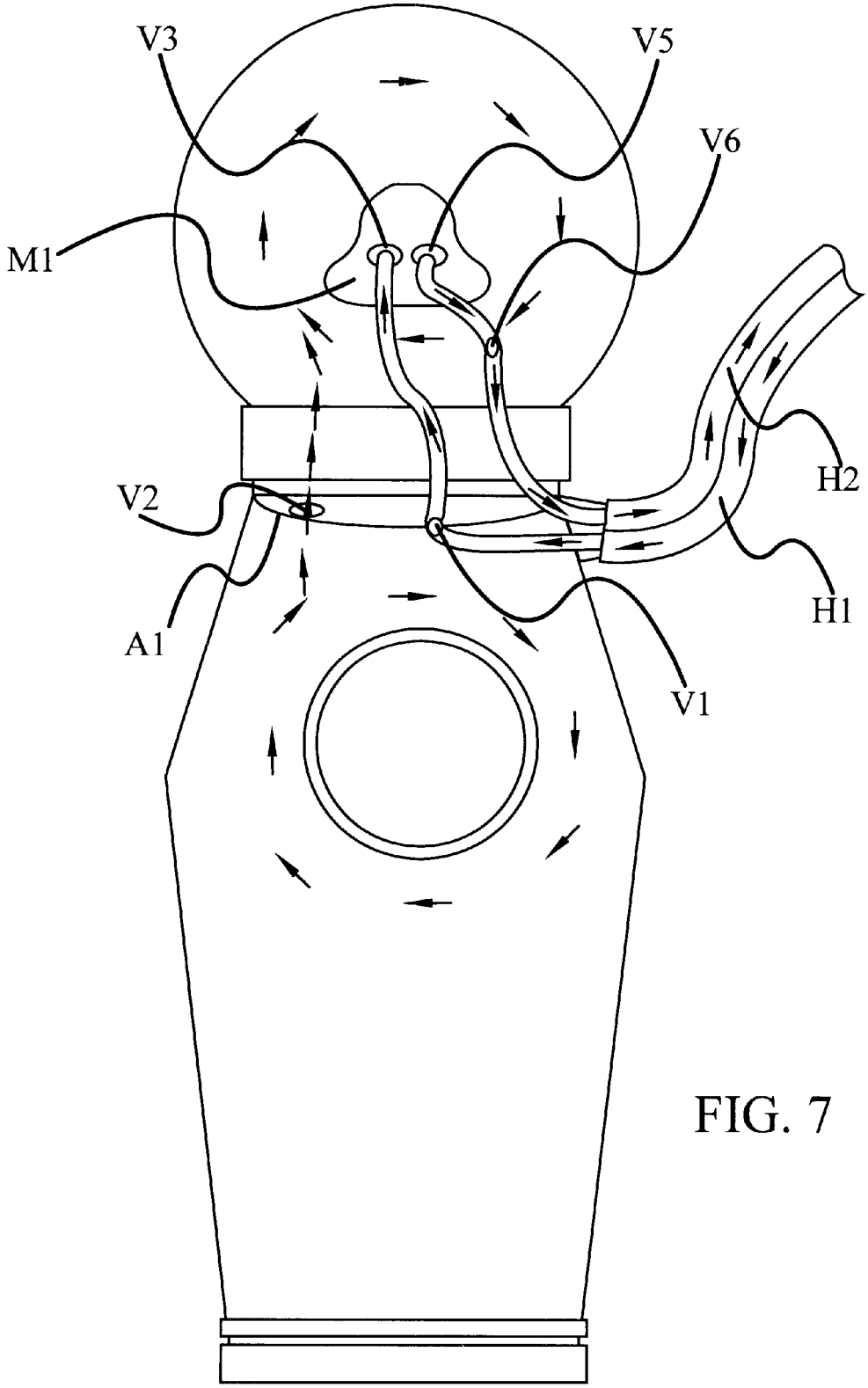
FIG. 7. Is a diagram of the air flow using valves v1 through v6, with rubber apron a1 for sealing carapace from helmet.

FIG. 7. Is a diagram of the air flow using valves v1 through v6, with rubber apron a1 for sealing carapace from helmet.

Figure 8:
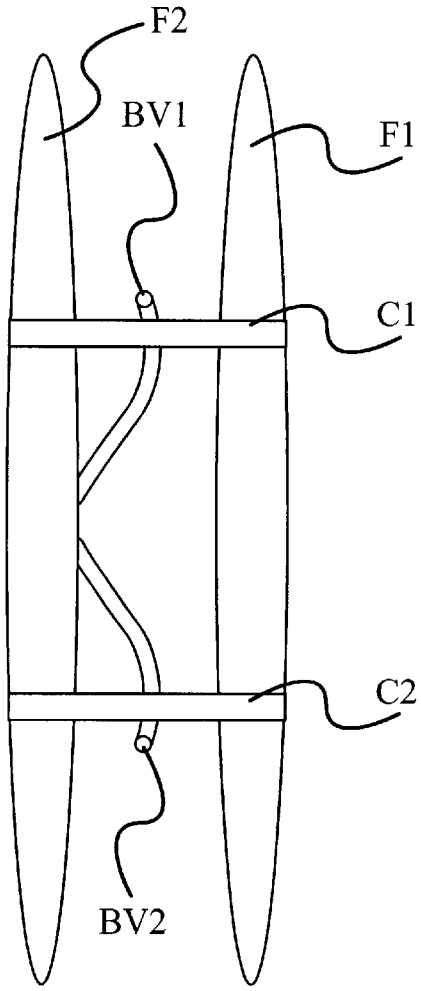
FIG. 8. Is a top view of the float that holds the air intake and exhaust hose surface ends out of the water. F1 is the right float, F2 is the left float, c1 & c2 are cross bars that holds the floats upright and together. Bv1 is the valve for keeping water out of intake bv2 is the valve for keeping water out of exhaust.

FIG. 8. Is a top view of the float that holds the air intake and exhaust hose surface ends out of the water. F1 is the right float F2 is the left float, c1 & c2 are cross bars that holds the floats upright and together. Bv1 is the valve for keeping water out of intake bv2 is the valve for keeping water out of exhaust.

Figure 9:
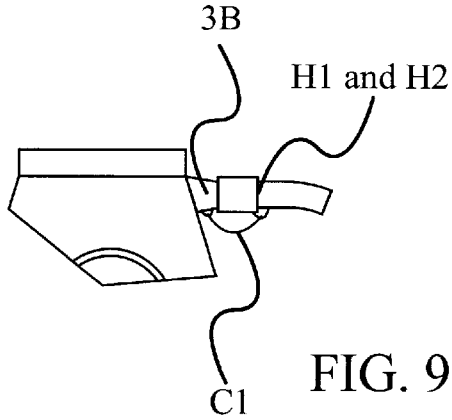
FIG. 9. Is a view of air hose and cable attachment, h1 & h2 are the air hose attachments. 3*b* is the mount on carapace for air hose attachments. C1 is a ⅛-inch stainless steel cable attached to 3*b*, and to the surface float, combined with and attached to air hoses, to form a single unit until it reaches the floats, where they separate into their individual components.

FIG. 9. Is a view of air hose and cable attachments h1 & h2 are the air hose attachments. 3*b* is the mount on carapace for air hose attachments. C1 is a ⅛-inch stainless steel cable attached to 3*b* and to the surface float. It is combined with and attached to air hoses to form a single unit until it reaches the floats, where they separate into their individual components.

Figure 10:
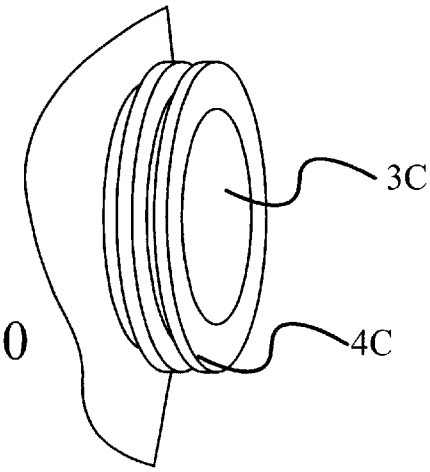
FIG. 10. Is a view of the armhole, either a flexible accordion or a groove, to give watertight seal for sleeves. This is not necessary on shirt type. 3*c* is arm hole, 4*c* is accordion type.

FIG. 10. Is a view of the armhole, either a flexible accordion or a groove, to give watertight seal for sleeves not necessary on shirt type. 3*c* is arm hole, 4*c* is accordion type.

Figure 11:
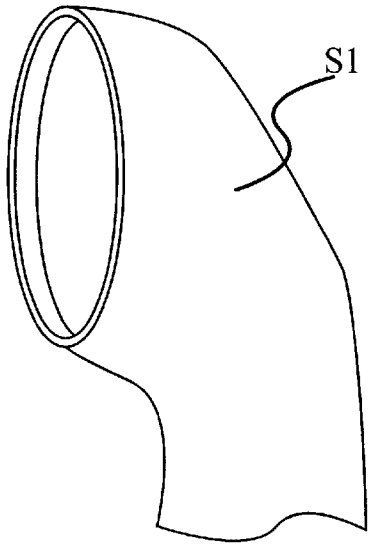
FIG. 11. Is a view of sleeve s-1 made of flexible rubber and reinforced at upper end with tough non-stretchable fabric I E canvas, or plastic or chain mail like metal.

FIG. 11. Is a view of sleeve s-1 made of flexible rubber and reinforced at upper end with tough non-stretchable fabric I E canvas, or plastic or chain mail like metal.

Figure 12:
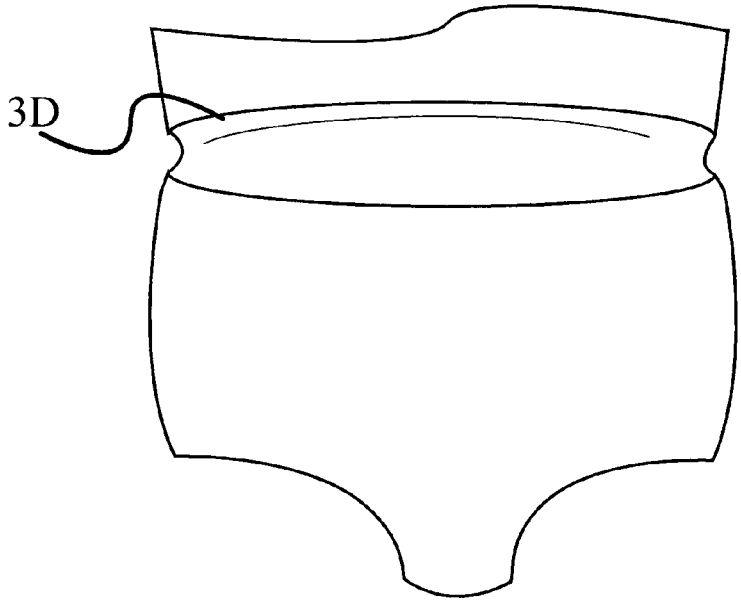
FIG. 12. Is a view of the waist of carapace with groove or grooves to facilitate water tight seal 3-*d*.
Figure 12B:
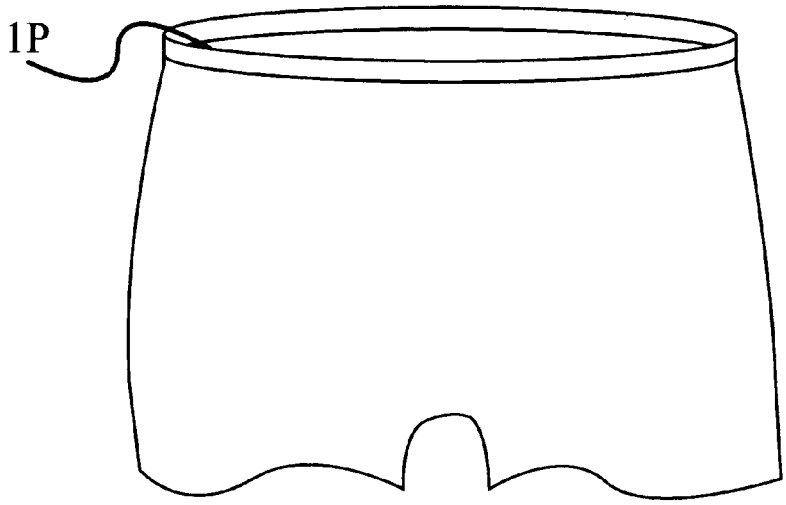
Figure 12C:
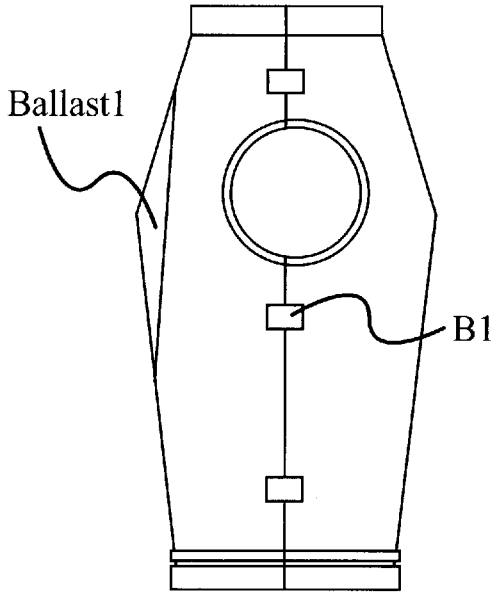
Figure 12E:
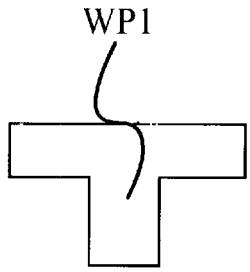
Figure 12D:
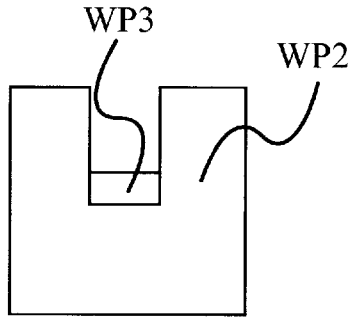
Figure 12F:
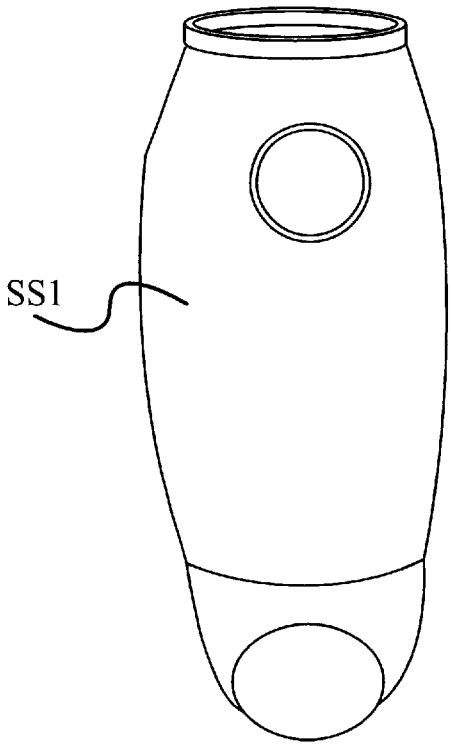
Figure 12H:
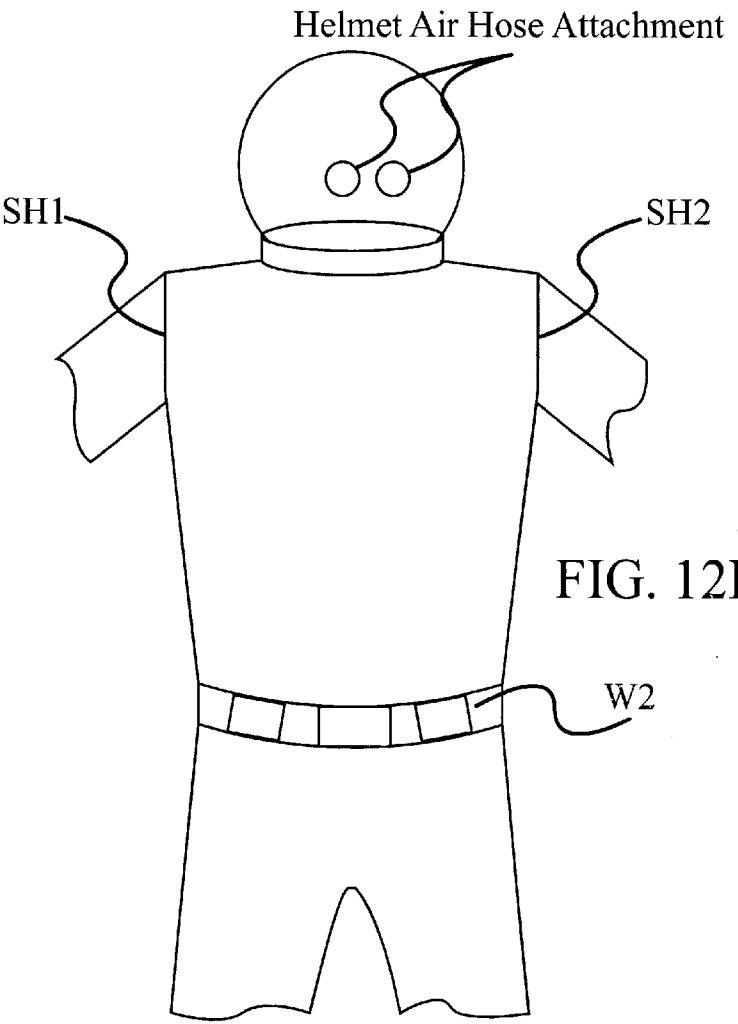
Figure 12G:
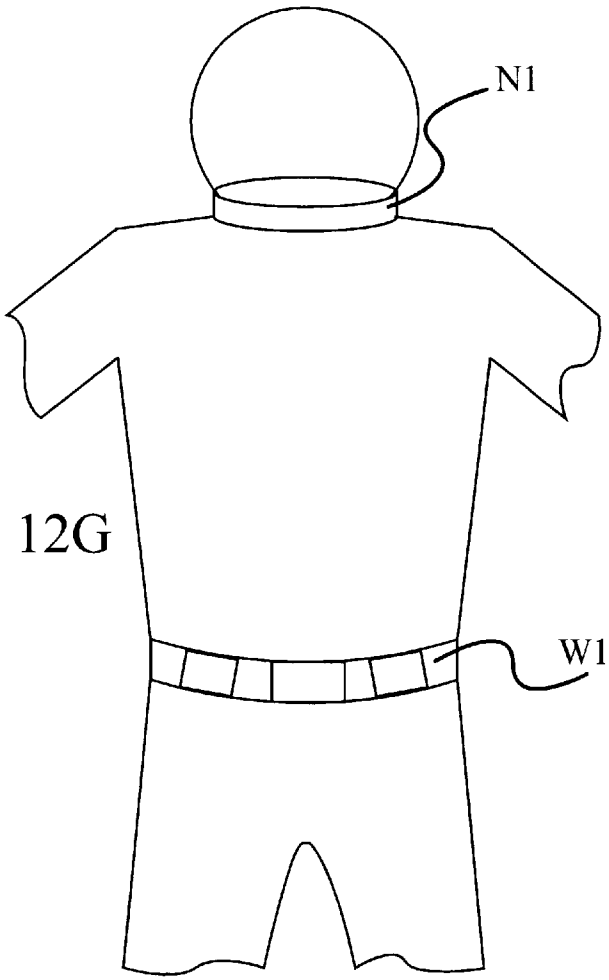

FIG. 12. Is a view of the waist of carapace with groove or grooves to facilitate water tight seal 3-*d*.

FIG. 12-*b*. is a view of pants or shorts with thickened reinforced waist made of rubber. The reinforced waist fits in the groove in FIG. 12 s-1.

FIG. 12-*c*. and 12-*e* Is a side view of carapace with ballast 1 showing possible placement of weight to neutralize buoyancy of air in carapace. b-1 is either buckles with ratchets to seal or hook and ring closures in overshirt version. Wp-1 to wp-3 is airtight seal for sleeve version.

FIG. 12-*f*. is a view of one-piece carapace that is put on from the bottom. This version is simpler but more difficult to put on.

FIG. 12-*g*. is front view of super snorkel with overshirt version in place. N-1 is the neck seal accomplished with ratchet version of belt & buckle. W-1 is waist version of the same.

FIG. 12-*h*. is a front view of supersnorkel with sleeves and pants (or short versions of either). SH-1 & SH-2 are sleeve seals, W-2 is pants seal with racketing buckle as on ski boot bindings. This also shows the variant hose attachment to the helmet which makes getting into and out of the suit much easier.

Figure 13:
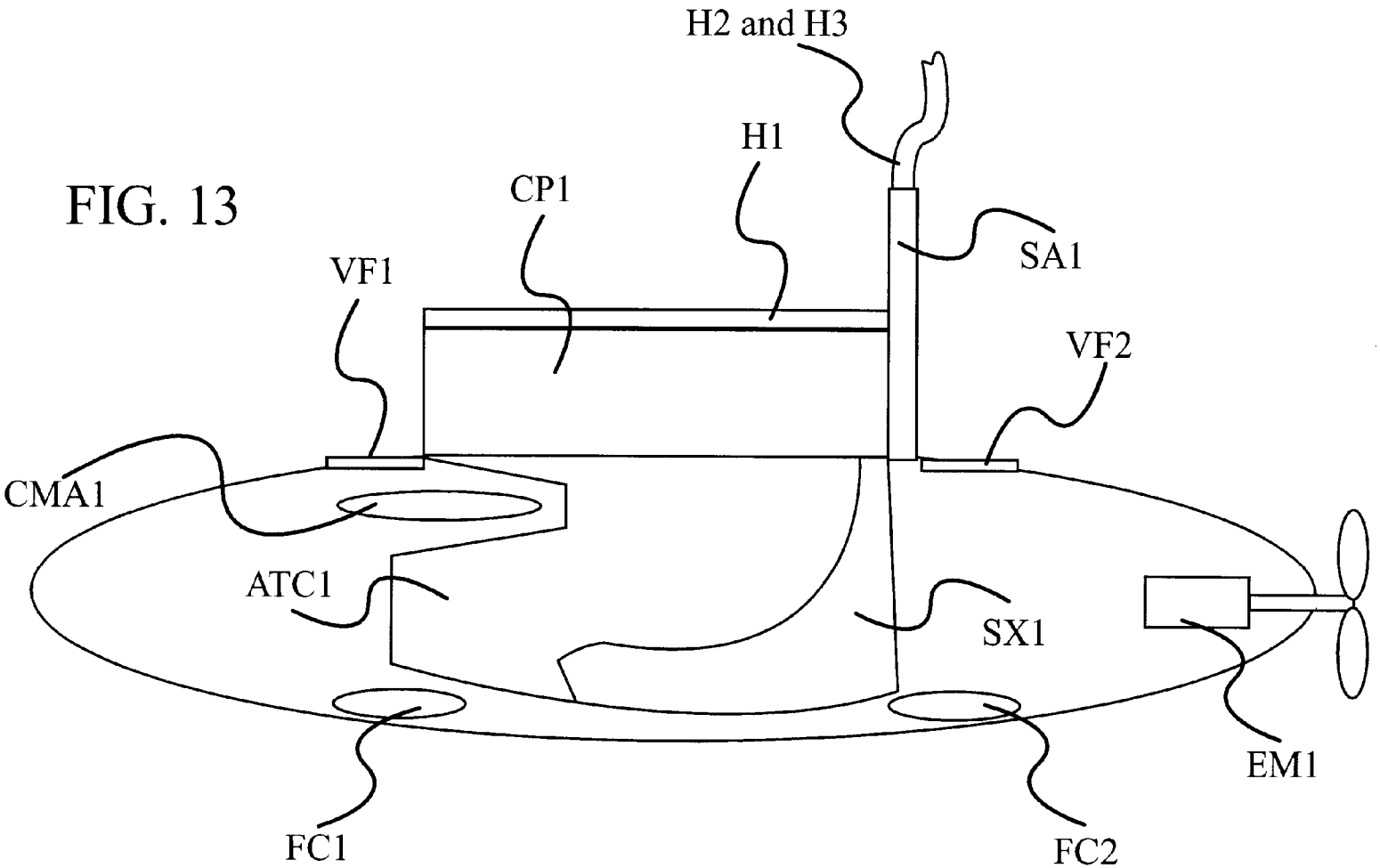
FIG. 13 is a side view of a super snorkel sub having an air-tight compartment ATC-1 closed by a hatch H-1. Beneath the hatch is a clear plastic section. Two valves VF-1 and VF-2 allow for flooding. A snorkel attachment connects hoses to the sub. A seat is provided in the sub and an electric motor is provided for locomotion.

FIG. 13 shows a super snorkel sub having an air-tight compartment ATC-1 closed by a hatch H-1. Beneath the hatch is a clear plastic section for easy visualization by the occupant. Two valves VF-1 and VF-2 allow for flooding of compartments of the sub for buoyancy. A snorkel attachment connects hoses to the sub for receipt and removal of air. A seat is provided in the sub for use by the occupant and an electric motor is provided for locomotion.

Figure 14:
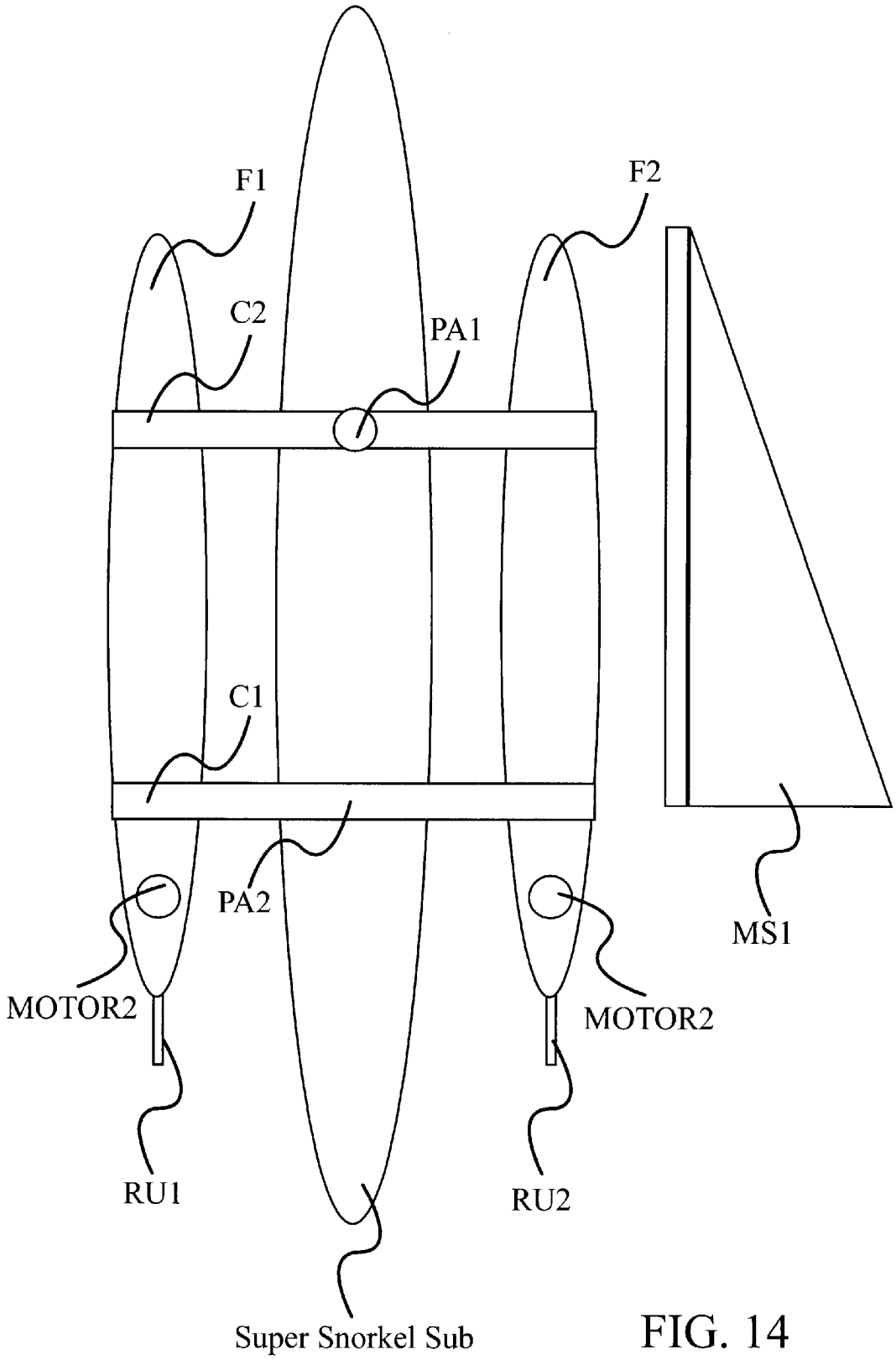
FIG. 14 is a top view of a motorized or sailing super snorkel sub. The sub is supported by pontoons which have rudders Ru-1 & 2 and either two motors or a mast with a sail-MS-1.

FIG. 14 is a top view of a motorized or sailing super snorkel sub. The sub is supported by pontoons which have rudders Ru-1 & 2 and either two motors or a mast with a sail-MS-1.

PREFERRED EMBODIMENT OPERATION

FIG. 1. The side view of complete super snorkel with visible parts showed in relationship to each other.

FIG. 2. The bubble helmet 2-*a*, even though simple in construction offers superior 360% view. By keeping pressure out several serious problems are avoided, such as barrow pressure damage to the ears and the accompanying pain and often vertigo. This also makes it far simpler in rising over under water ridges or other obstacles. Even inexperienced divers should find the experience easy and very pleasurable. Even very cold water is made much more comfortable by this protection. 2-*b* easy to attach and remove helmet with complete watertight seal.

FIG. 3. The carapace offers protection for the lungs and diaphragm from the pressures under water allowing the diver to breathe surface pressure air, thus simply avoiding all the complications and possible dangers of compressed air. Carbon monoxide poisoning, embolus, suddenly running out of air, swallowing compressed air, etc. are all eliminated. A very earth friendly arrangement since no outside energy to compress air is needed. Weight attached the chest of the carapace helps compensate for the large air bubble that would have to be submerged. The arm openings allow the diver to interact with the outside world. While the sleeves allow for the watertight seal that is necessary, the waist seal allows for airtight integrity from the leg area, while allowing for a natural swimming motion.

FIG. 4. For a military application the addition of liquid-food and water, would make long stays under water possible, with Kevelar added for protection from projectiles. A divers stay under water for a long period could be made even easier. With no time limit to submersion leaving the water at a beneficial time would be advantageous.

FIG. 5. Is a detail of the one way valves like the ones use in gas masks etc., used to control airflow in super snorkel. 5*a* is the base made of plastic or metal. 5*b* is the soft (surgical) rubber flapper valve.

FIG. 6. Is a detail of the valve arrangement in super snorkel. On exportation air enters the carapace at valve #1. On inspiration air travels through valve #2 into the helmet, and valve #3 into mask and then into the lungs. Air in the helmet travels through valve #4 exiting mask into the exhaust hose. On exhalation air travels through valve #5 into the exhaust hose, giving a complete air exchange with each breath, keeping the helmet clear of condensation and insuring a completely fresh breath with each cycle. In this way the mask is not absolutely necessary but is good insurance and it does not impede speech.

FIG. 6-B. Is a detail of the 2 valve arrangement in super snorkel. Air enters through the intake hose on inspiration and into the lungs. On inspiration the air can not go back into the intake hose due to the one way valve. Instead it goes out into the body and helmet of the suit and up the out hose to the surface. The used air can not reenter the mask due to the one way valve.

FIG. 7. Is an aid to visualizing the airflow. The path of fresh air as described above is used air exiting super snorkel as described above. The rubber apron for sealing the carapace from the helmet is used to make sure fresh air is circulated with each breath.

FIG. 8. Is The top view of the float that holds the air intake and exhaust hose surface ends out of the water made of light foam or other light materials for ease of movement through the water. The valves on the ends of the hoses are to keep water from entering the super snorkel and could be a simple ball valve of a more complex splashguard.

FIG. 9. Is the connection for the air hoses and the stainless steel cable to super snorkel. The cable is to insure the integrity of the air hoses by strongly securing to both super snorkel and the float. Between float and super snorkel the cable should be firmly attached to the hoses to prevent separate movement and wear as well as the danger of entanglement.

FIG. 10. Is the armhole this could be a simple groove for attachment of an accordion pleat for increased strength to keep the sleeve material from interring the carapace.

FIG. 11. Is the portion of the sleeve that attaches to super snorkel and it would have a thickened rubber portion to attach to the armhole groove with either, canvas, synthetic material, of metal chain mail type of fitting or the accordion pleat to prevent the sleeve from interring the carapace from the pressure of the water at depth.

FIG. 12. Is the area for the attachment of the pants and if a shirt type of sealing for the tail of the shirt to make a water tight seal at the pelvic region.

FIG. 12-*b*. Is the thickened reinforced area on the pants, where a canvas, synthetic material, or a metal chain mail type of fitting is used to prevent the area from interring the super snorkel at depth.

FIG. 12-*c*. is the carapace with one way of attaching the ballast weight to neutralize the buoyancy of the air in the carapace. Also the ratchet buckles for watertight seal of the hook and loop closures for the shirt type are shown. And one way of sealing the carapace for the sleeve version is detailed.

FIG. 12-*f*. ss-1 is the "barrel" type of carapace which is crawled into. This is a much simpler device but is also more difficult to put on.

FIG. 12-.G. is the super snorkel as seen from the front with the overshirt version in place. The seal at the neck is accomplished with a ratchet version of a belt & buckle, like the one on the waist, and would be like the ones used on ski boots and load tie down buckles.

FIG. 12-*h*. is the super snorkel with the sleeves and pants (or short versions of either). The pants seal with the ratcheting type buckle. This also shows the variant hose attachment to the helmet, which makes the suit easier to put on, and much easier to store. Other wise, the air flow follows the same paths, especially in the 2 valve model.

2 Valve Super Snorkel—Description

The FIG. 6-B shows the 2 valve system, and has some advantages and disadvantages. FIG. 6-B shows the arrangement of the valves and exit hole for air.

2 Valve Super Snorkel—Operation

Air enters the mask at valve 1 the intake valve then to the divers lungs the air exits through the exhaust valve and into the suit and out the exit hole to the surface.

Conclusions, Ramifications, and Scope

Accordingly, it can be seen that I have provided a diving device that allows greater depths than a standard snorkel, while keeping the safety virtues of breathing surface pressure air, giving a greater field of view and allowing the divers to communicate with each other. Simple and not requiring extensive training to use but reliable and giving access to the waters of a reef for example that many could not reach. Even many disabled should be able to use this system of diving. There is no limits to the dive as there is no worries about the bends or running out of air.

Although the description above contains many specificities, these should not be construed as limiting the scope of the invention but as merely providing illustrations of some of the presently preferred embodiments of this invention. Various other embodiments and ramifications are possible within its scope. For example, easier entry with the back of the suit opening up and closing similar to a russian space suit. Or the 2 valve system for even more simplicity. The breathing system could be used on small submarines or sailing craft with a center hull that can be used as a submarine, which would take away the time limits on the dive.

Thus the scope of the invention should be determined by the appended claims and their legal equivalents, rather than by the examples given.

What is claimed is:

1. A snorkel diving device comprising at least one elongated flexible air tube extending from a floatation device to a body covering including a carapace and a helmet; wherein the at least one tube extends through an outer surface of the body covering to a mask within the helmet where a one way valve allows air to be drawn from an end of the tube near the floatation device to an end of the tube at the mask solely by a diver's lung pressure.

2. An underwater breathing device for a diver, the device comprising:

a helmet configured to form a watertight region around the diver's head;

a carapace sealingly coupled to the helmet at a first end of the carapace, the carapace comprising:

a first opening at the first end of the carapace for the diver's head;

second and third openings on opposing sides of the carapace for the diver's arms; and at least a fourth opening at a second end of the carapace for the diver's legs;

at least one watertight seal associated with each of the second, third and fourth openings of the carapace;

a mask disposed within the watertight region of the helmet, and configured large enough to cover the diver's mouth and nose, the mask comprising:

a first aperture through which the diver may inhale air; and a second aperture through which the diver may exhale air; and at least one air hose coupled to the underwater breathing device comprising a first air hose configured to supply air to the diver.

3. The underwater breathing device of claim 2, wherein the helmet is a rigid helmet.

4. The underwater breathing device of claim 3, wherein the rigid helmet is formed of a high impact plastic.

5. The underwater breathing device of claim 2, wherein the at least one air hose is sealingly coupled to the underwater breathing device through helmet in a way to maintain the watertight region around the diver's head.

6. The underwater breathing device of claim 2, wherein the at least one air hose is sealingly coupled to the underwater breathing device through the carapace.

7. The underwater breathing device of claim 6, wherein the at least one air hose is sealingly coupled through the carapace at an air hose mount at the first end of the carapace.

8. The underwater breathing device of claim 2, wherein the carapace further comprises a neck flange and seal for sealingly coupling with an opening in the helmet.

9. The underwater breathing device of claim 2, wherein at least one of the watertight seals comprises one or more continuous grooves extending around a portion of the carapace.

10. The underwater breathing device of claim 9, further comprising at least one of a sleeve and pants having an opening adjacent the carapace, the opening comprising at least one thickened ridge configured to seat in the one or more continuous grooves of the carapace to thereby create a watertight seal.

11. The underwater breathing device of claim 2, wherein at least one of the water tight seals comprises an accordianed portion.

12. The underwater breathing device of claim 2, wherein at least one of the watertight seals comprises at least one of a buckle, a ratchet and a belt.

13. The underwater breathing device of claim 2, the carapace further comprising a ballast coupled to the carapace.

14. The underwater breathing device of claim 2, the carapace further comprising at least one of a food bladder and a water bladder coupled to the carapace.

15. The underwater breathing device of claim 2, the carapace further comprising a protective material attached thereto to protect the diver from projectiles.

16. The underwater breathing device of claim 15, wherein the protective material is Kevlar.

17. The underwater breathing device of claim 2, wherein the carapace is configured to open and close to simplify entry into the carapace by the diver, the carapace further comprising at least one ratcheting buckle configured to lock the carapace into a closed position such that the carapace worn by the diver is watertight.

18. The underwater breathing device of claim 2, wherein the at least one air hose comprises a second air hose configured to expel exhaust air from the diver to a surface of a body of water in which the diver is diving.

19. The underwater breathing device of claim 3, wherein the first hose is configured to supply air to the diver from a surface of a body of water in which the diver is diving without using an air pump.

20. The underwater breathing device of claim 2, the mask further comprising a first valve through which air is inhaled, and a second valve through which air is exhaled.

21. The underwater breathing device of claim 2, further comprising a float residing on a surface of a body of water in which the diver is diving, the float maintaining an end of the at least one air hose above the surface of the water.

22. A method of breathing under water, the method comprising:

wearing a carapace to protect a diver's chest and diaphragm against water pressure;

wearing a helmet coupled to the carapace by a watertight seal;

wearing a mask within the helmet, the mask configured to cover both the diver's mouth and nose;

inhaling fresh air through a one-way intake valve associated with an elongated hose extending from the mask to above a surface of a body of water; and exhaling used air through a one-way exhaust valve on the mask into the helmet.

23. The method of claim 22, further comprising:

passing fresh air through a first valve on the carapace to the one-way intake valve and used air through a second valve on the carapace into an exhaust hose when used air is exhaled through the one-way exhaust valve on the mask; and passing fresh air through a third valve on the carapace into the helmet when fresh air is inhaled through the one-way intake valve on the mask.

24. The method of claim 22, wherein the air is not mechanically pumped or compressed.

25. The method of claim 22, wherein the air is inhaled from above the surface of the water solely through the diver's lung power.

* * * * *

UNITED STATES PATENT AND TRADEMARK OFFICE

CERTIFICATE OF CORRECTION

PATENT NO. : 6,401,711 B1
DATED : June 11, 2002
INVENTOR(S) : Tibbs

It is certified that error appears in the above-identified patent and that said Letters Patent is hereby corrected as shown below:

Column 8,
Line 55, "The underwater breathing device of claim 3,…" should read -- The underwater breathing device of claim 2,… --

Signed and Sealed this

Tenth Day of September, 2002

*Attest:*

*Attesting Officer*

JAMES E. ROGAN
*Director of the United States Patent and Trademark Office*